US006558010B2

(12) United States Patent
Takahashi

(10) Patent No.: US 6,558,010 B2
(45) Date of Patent: May 6, 2003

(54) REFLECTING MIRROR

(75) Inventor: Noboru Takahashi, Tokyo (JP)

(73) Assignee: Takaroku Shoji Co., Ltd., Tokyo (JP)

( * ) Notice: Subject to any disclaimer, the term of this patent is extended or adjusted under 35 U.S.C. 154(b) by 0 days.

(21) Appl. No.: 09/925,341

(22) Filed: Aug. 9, 2001

(65) Prior Publication Data

US 2003/0030924 A1 Feb. 13, 2003

(51) Int. Cl.[7] ..... G02B 5/12

(52) U.S. Cl. ..... 359/552; 359/528; 359/839; 362/307; 362/310

(58) Field of Search ..... 359/528, 535, 359/543, 552, 839; 362/296, 307, 308, 309, 310

(56) References Cited

U.S. PATENT DOCUMENTS 3,721,489 A * 3/1973 Horvath ..... 33/348
5,122,939 A * 6/1992 Kazdan et al. ..... 359/528
5,535,111 A * 7/1996 Wedell ..... 313/113
5,703,719 A * 12/1997 Chen ..... 359/515

FOREIGN PATENT DOCUMENTS

JP 2000 56108 2/2000

* cited by examiner

*Primary Examiner*—Mark A. Robinson
(74) *Attorney, Agent, or Firm*—Jordan and Hamburg LLP

(57) ABSTRACT

An attaching part of a reflecting mirror is fixed to a guardrail of a road. A solar cell device of a solar-powered light emitter accumulates electricity produce by sunlight of the daytime, and a light emitting diode emits light at nighttime. When a front panel is irradiated with light from a headlight of an automobile running at nighttime, the light is reflected off a diamond cut of a rear surface, in particular, then the light is reflected off the surface of an inner panel on which reflecting surface work is made, and the reflected light is irregularly reflected by the diamond cut surface, thereby functioning as a driving sign in combination with the emitted light from the light emitting diode. Dirt adhered to the front surface of the front panel peels off because of a self purification effect of titanium oxide on the front surface.

20 Claims, 7 Drawing Sheets

REFLECTING MIRROR

BACKGROUND OF THE INVENTION

The present invention relates to a reflecting mirror which reflects light from a headlight of automobile, the reflecting mirror being attached, for example, to a guardrail, roadside or medial strip of a road in use.

Heretofore, reflecting mirrors which reflect light from a headlight of automobile have been attached to guardrails or fences of road. Various kinds of reflecting mirrors have been proposed: a first conventional example is that a front panel having a reflecting property is attached to a front opening of a bowl-like holding part constituting a main body of the reflecting mirror; a second example is that specular working is made on an inner surface of the holding part for improving the reflection efficiency; and a third example is that a bulb is placed inside the holding part. These are used as signs for car driving at nighttime and useful for driving safety. Many of these conventional reflecting mirrors have a front surface with a transparent reflecting panel into which a fluorescent pigment is mixed and a rear surface in which a prism formed. Therefore, while such a reflecting mirror is attached to a guardrail, as the reflecting surface will become dirty in a short time by splashes of mud water from the road surface and by pollutants contained in rain and air, the reflecting efficiency will deteriorate. This makes it difficult to ensure the driving safety of an automobile in bad conditions such as nighttime or raining. In view of the above, a fourth conventional example having a supporting shaft is projected from a center of the front panel, and a wind wheel having a brush is rotatably attached to the supporting shaft has been already put into practical use. Since the wind wheel is rotated by wind and the brush cleans the front panel by this rotation, such configuration is very useful for keeping the reflecting property.

However, in the second conventional example in which specular-working such as vapor-deposition or plating is made on the inner surface of the holding part, covering portions such as the rear surface of the holding member, on which such vapor-deposition or plating is not to be made, is required in order that those portions do not become dirty at the time of vapor-deposition or plating. Such a preparation is complicated and significantly affects the production costs. In the third conventional example in which a bulb is placed inside the holding part, electric wiring work is required. In the fourth conventional example utilizing the reflecting mirror with the wind wheel, splashes of mud water from the road surface and pollutants in rain and air will easily go into a bearing between the supporting shaft and the wind wheel, which makes the wind wheel not rotate smoothly and finally unable to rotate. As a result, the reflecting surface becomes dirty and the reflecting efficiency deteriorates, and such reflecting mirror does not contribute to ensure the safety of car driving at nighttime.

Furthermore, it is currently required to recycle scrapped synthetic resin parts, packages and the like of automobiles and household-electrical appliances from the view point of making effective use of resources. It has been found that the material of the reflecting mirror according to the present invention is satisfactory in the point of strength even when recycled synthetic resins are used.

BRIEF SUMMARY OF THE INVENTION

In view of the above, it is an object of the present invention to provide a reflecting mirror capable of decreasing production cost, eliminating the necessity of electric wiring and capable of keeping the reflecting efficiency for a long time.

It is another object of the present invention to improve the reflecting efficiency of the reflecting mirror and to keep the reflecting efficiency for a long time. In particular, when a front surface of a front panel is coated with titanium oxide, the front surface is prevented from becoming dirty, so that it is possible to provide a reflecting mirror capable of keeping the reflecting efficiency for the longer time.

It is yet another object of the present invention to provide a reflecting mirror in which its holding part, attaching part and inner panel is formed out of recycled synthetic resin and such application enables use of recycled synthetic resin much wider.

An embodiment of a reflecting mirror according to the present invention comprises a holding member, an inner panel, a front panel and a solar-powered light emitter, the holding member being formed of a synthetic resin, having a hollow holding part with front surface opening and a attaching part for attaching to other members; the holding part being formed with a housing; the inner panel being a plate having a through hole and having a front surface formed into a reflecting surface; the front panel being formed of a transparent plastic material; the inner panel being provided in parallel with the front surface opening of the holding part in the holding part; the solar-powered light emitter being inserted into the housing of the holding part via the through hole of the inner panel; the front panel being attached to the front surface opening of the holding part.

Another embodiment of the present invention has the front surface of the front panel coated with titanium oxide.

A still further embodiment of the present invention has a diamond cut made on the rear surface of the front panel. This diamond cut surface comprehends any surface that irregularly reflects or exerts a prism effect.

Another embodiment of the present invention has the holding member and the inner panel formed of a recycled synthetic resin material.

DETAILED DESCRIPTION OF THE INVENTION

Figure 1:
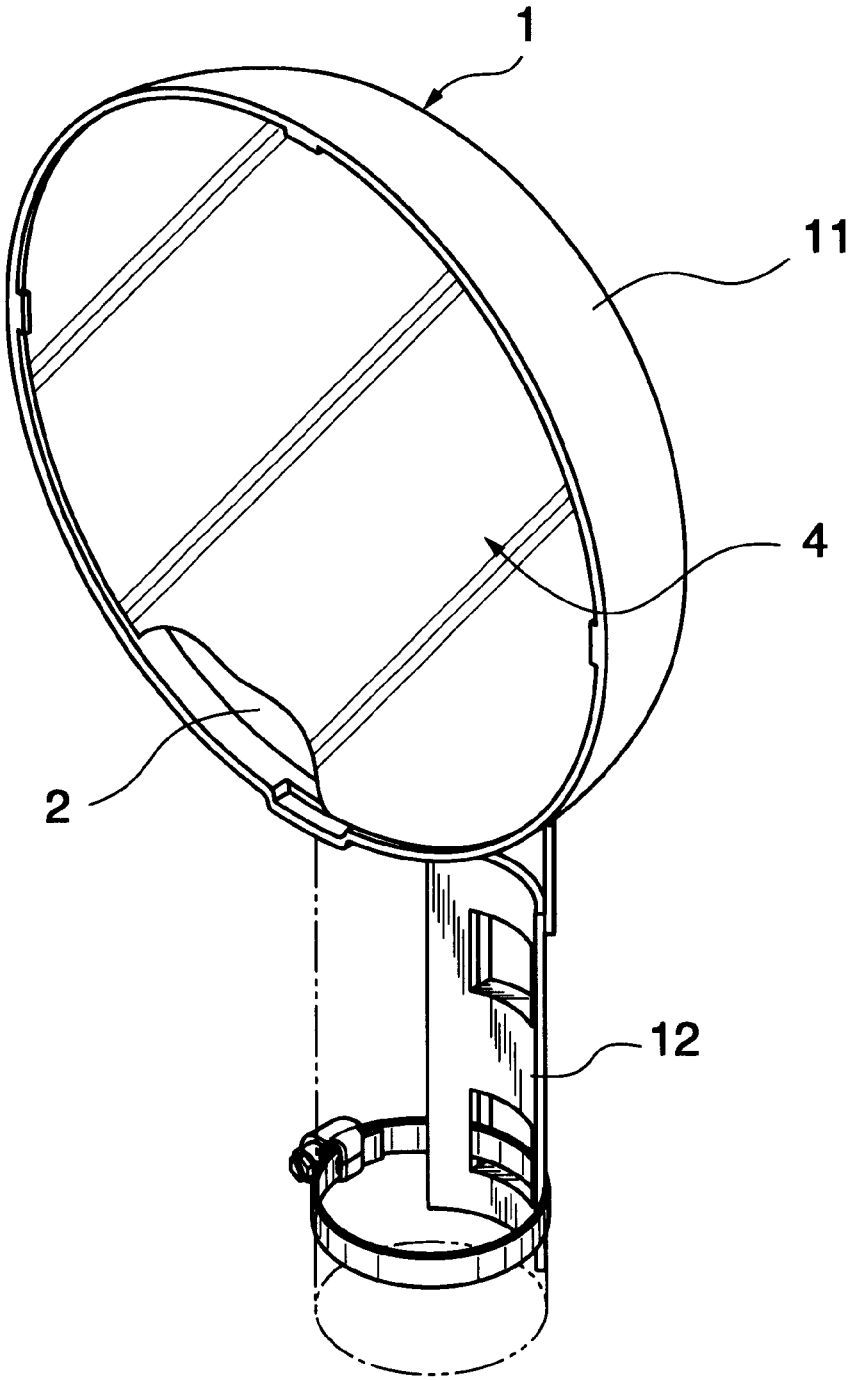
FIG. 1 is a partially cutaway view in perspective of an entire reflecting mirror.

Referring to FIG. 1, a holding member 1 is formed of a material such as polypropylene, polystyrene, ABS and the like, and if materials that have been recycled by a recycle system preferably from scrapped parts of automobiles and household electrical appliances, plastic packages and the like are used for the material of the holding member, it is possible to broaden the recycling range of recycled synthetic resins.

Figure 2:
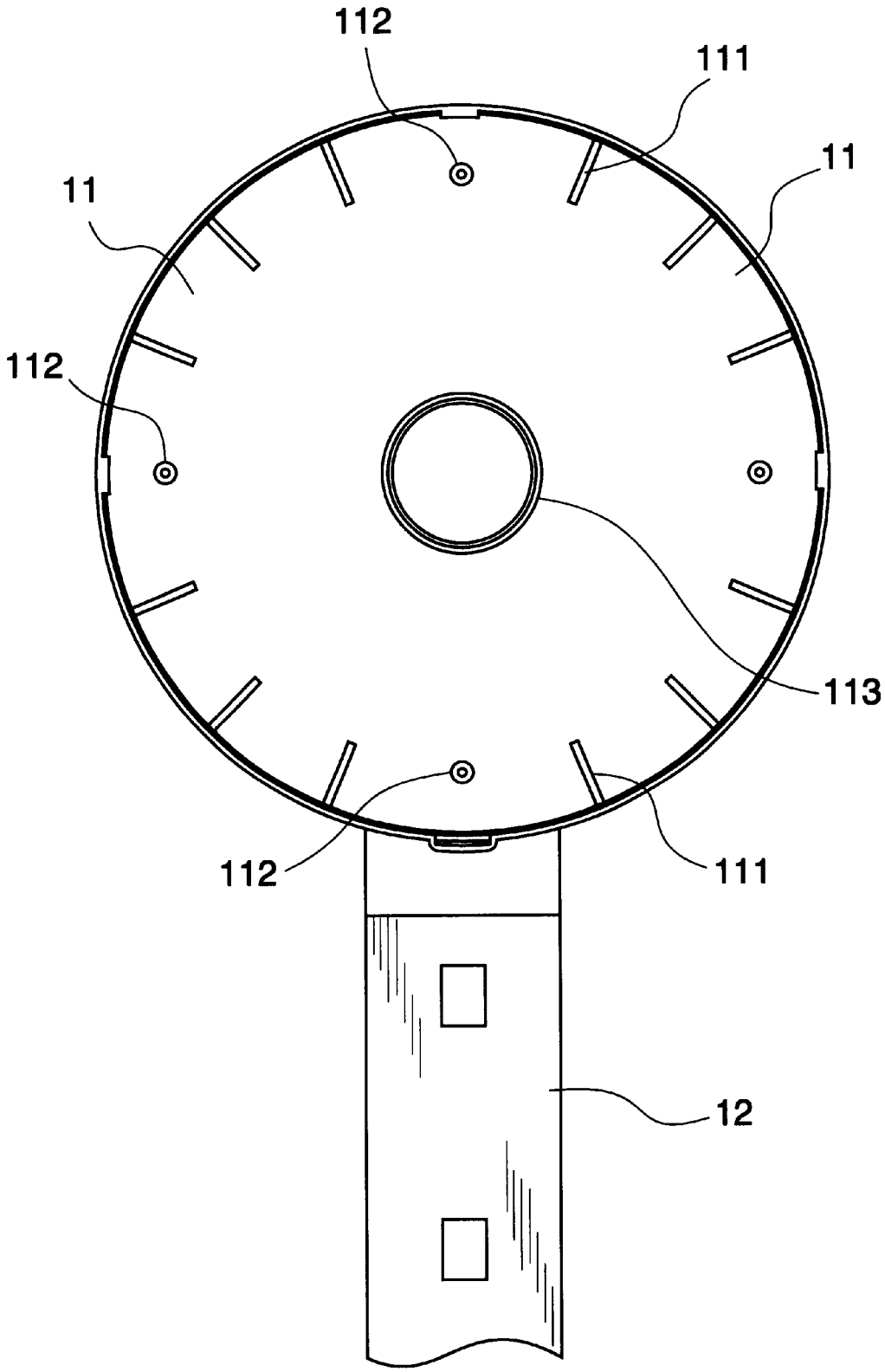
FIG. 2 is an enlarged front view showing a state that a reflecting panel is removed from a holding part.
Figure 3:
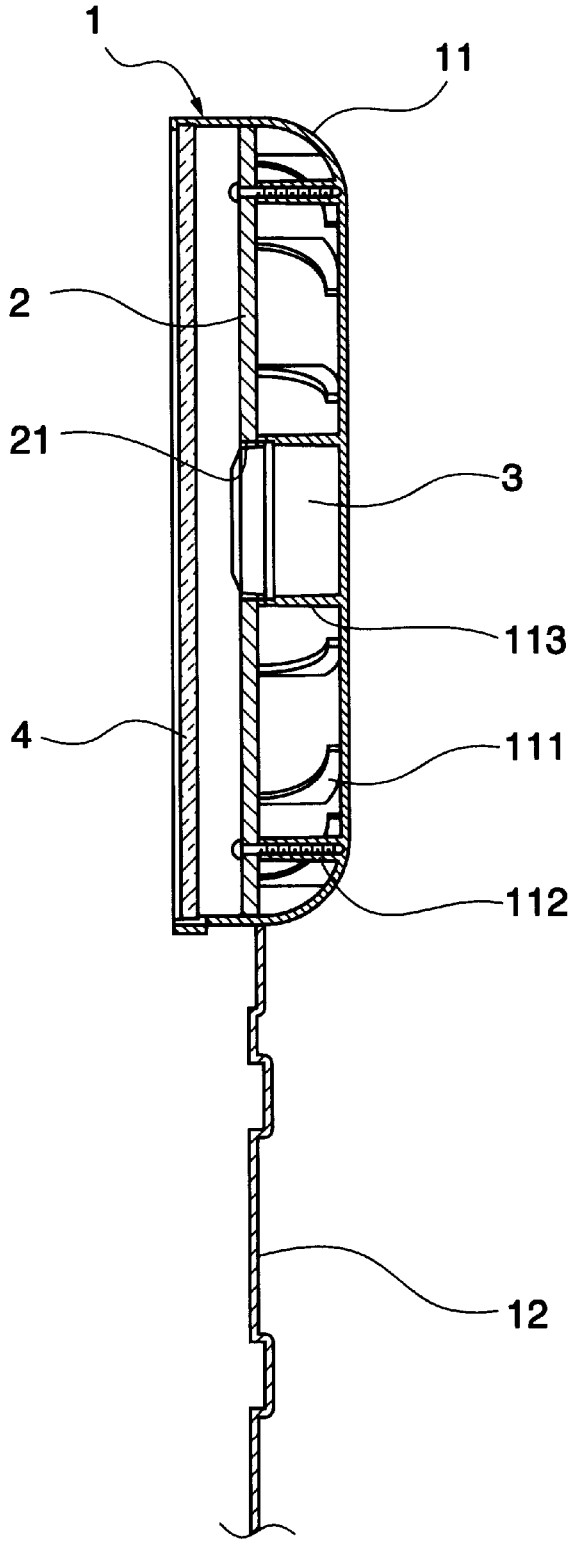
FIG. 3 is an enlarged section view along a perpendicular center line of the reflecting mirror.

An upper half part of the holding member 1 is a holding part 11 which is a bowl-like hollow member with forward opening, and a lower half thereof is an attaching part 12 capable of being attached to a supporting shaft of a guardrail or a fake-wood column made of scrapped plastic. As shown in FIGS. 2 and 3, the inner surface of the holding part 11 is so configured that a plurality of ribs 111 are radially formed at predetermined angular displacements in a peripheral part of an inner wall surface; attaching columns (bosses) 112 are provided in four positions, that is, upper, lower, left and right positions in protruded manner; and a circular housing 113 is formed in the center of the holding part 11, whose interior is the housing of a solar-powered light emitter 3. The top surfaces of the ribs 111, the attaching columns 112 and the housing 113 are on the same level as shown in FIG. 3.

Figure 4:
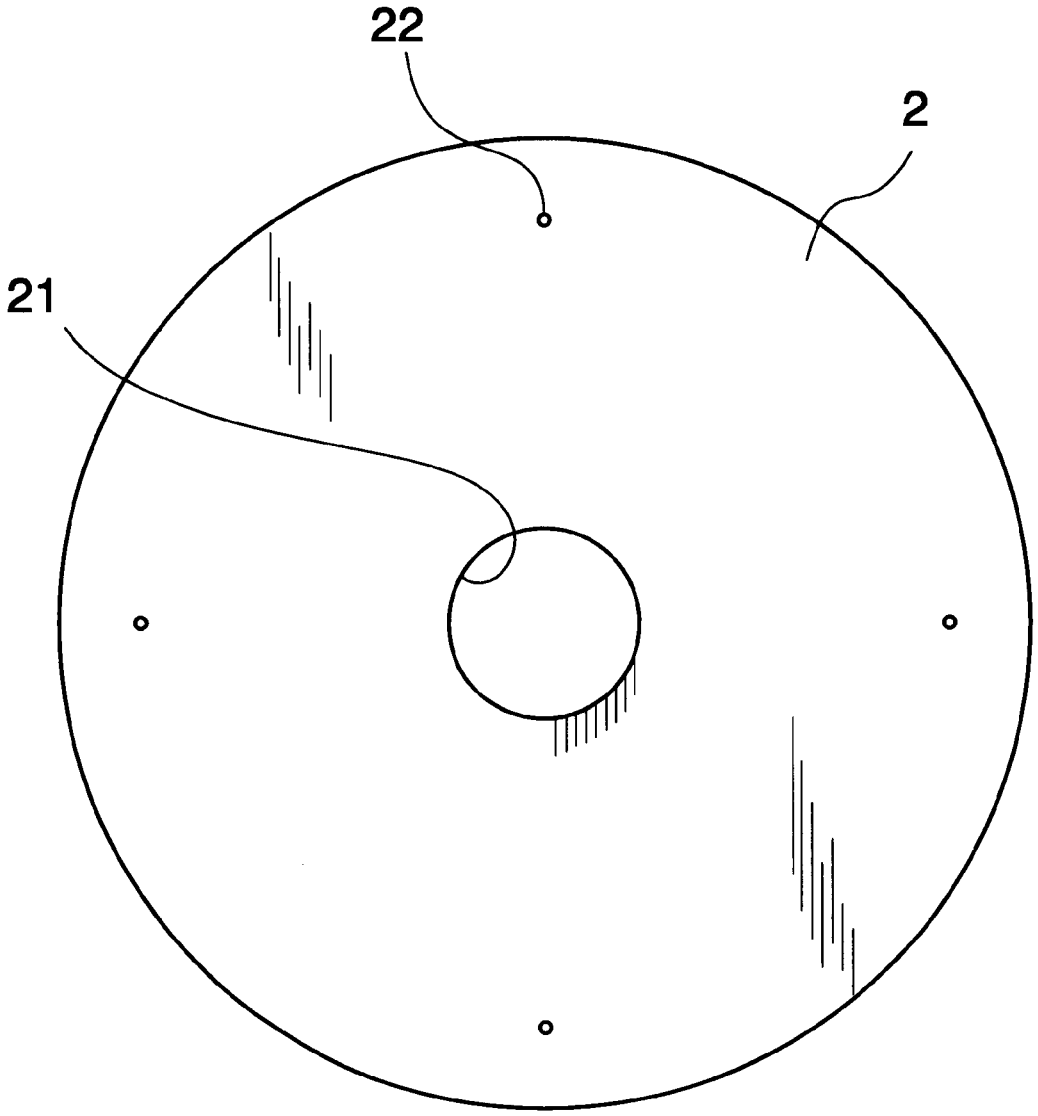
FIG. 4 is a front view of an inner panel.

As shown in FIGS. 3 and 4, the inner panel 2 is a disc-like member capable of set adjacent to the inner wall of the holding part 11. As shown in FIG. 4, a through hole 21 is pierced at a center portion, and attaching small holes 22 are provided in four positions, that is, at the upper, the lower, the left and the right. The through hole 21 is of a size and shape corresponding to those of the housing 113, and the attaching small holes 22 are provided in the positions corresponding to the attaching columns 112.

A front surface of the inner panel 2 is a reflecting surface, whose property is worked by plating, or by putting a hot stamp foil, that is, a foil obtained by adhering a foil on which aluminum or chromium is vapor deposited on the surface of the film. Chromium plating or chromium vapor deposition is preferred from the point of preventing the reflecting surface from turning black.

The surface of the inner panel 2 is formed into a reflecting surface by specular working. And the present invention proposes the inner panel described below in order to make specular work on the surface of the inner panel formed of a plastic material of single grade with high dimensional accuracy at the time of forming the inner panel for eliminating the necessity of applying an undercoat agent as a pretreatment of vapor deposition of the specular working, thereby improving the heat resistance of the inner panel, and decreasing the shrinkage of the inner panel.

The inner panel 2 is obtained by forming a granular plastic material consisting of a plastic and an inorganic additive added thereto, and performing specular working on the surface thereof. The plastic is either one selected from olefinic resins, ABS resin and styrol resin. The olefinic resins are, for example, polyethylene or polypropylene.

The additive is selected from oxides, hydroxides, carbonates, sulfates, silicates, nitrides, carbons and potassium titanate. The detailed explanation of additive is as follows.

The "oxides" mean one or plural oxide(s) selected from diatomaceous earth, alumina, magnesium oxide, titanium oxide, zinc oxide and antimony oxide. The "hydroxides" mean one or plural hydroxide(s) selected from magnesium hydroxide, aluminum hydroxide and basic magnesium carbonate. The "carbonates" mean one or plural carbonate(s) selected from calcium carbonate, magnesium carbonate and barium carbonate. The "sulfates" mean one or plural sulfate (s) selected from calcium sulfate, calcium sulfite and barium sulfate, and the "silicates" mean one or plural silicate(s) selected from calcium silicate, talc, kaolin clay, mica, zeolite, attapulgite, bentonite, sericite, aluminum silicate, feldspar powder, magnesium silicate and apatite. The "nitrides" mean silicon nitride, and the "carbons" mean selected from carbon black and graphite.

Next, the amount of those additives to be added will be explained.

The amount of addition of silica, diatomaceous earth, alumina and magnesium oxide of the oxides is in the range of 20 to 60% by weight, the amount of addition of titanium oxide, zinc oxide and antimony oxide of the oxides is in the range of 25 to 70% by weight, the amount of addition of the hydroxides is in the range of 20 to 60% by weight, the amount of addition of calcium carbonate and magnesium carbonate of the carbonates is in the range of 20 to 60% by weight, the amount of addition of barium carbonate of the carbonates is in the range of 25 to 70% by weight, the amount of addition of calcium sulfate and calcium sulfite of the sulfates is in the range of 20 to 60% by weight, the amount of addition of barium sulfate of the sulfates is in the range of 25 to 70% by weight, the amount of addition of the silicates is in the range of 20 to 60% by weight, the amount of addition of the nitrides is in the range of 20 to 60% by weight, the amount of addition of the carbons is in the range of 10 to 50% by weight, and the amount of addition of the potassium titanate is in the range of 20 to 60% by weight.

The above limitations for the amount of addition are defined so as to ensure adhesion power of vacuum plating and peel strength of electrolytic plating, nonelectrolytic plating and spattering deposition, and so as to prevent the mechanical properties of the plastic product itself such as tensile yield strength, tensile rupture strength, break elongation, bending strength and bend elastic constant from deteriorating.

Figure 5:
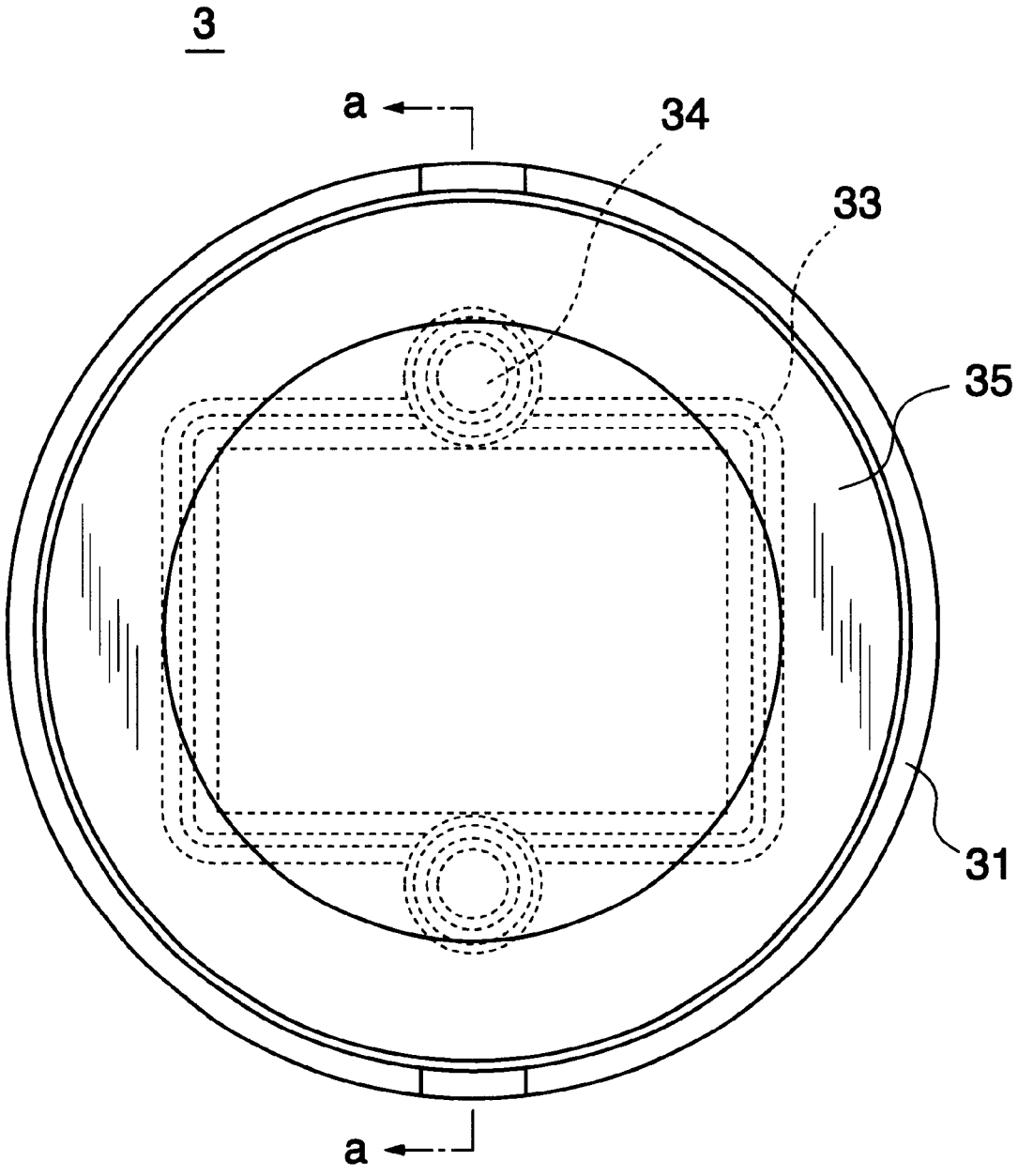
FIG. 5 is an enlarged front view of a solar-powered light emitter.
Figure 6:
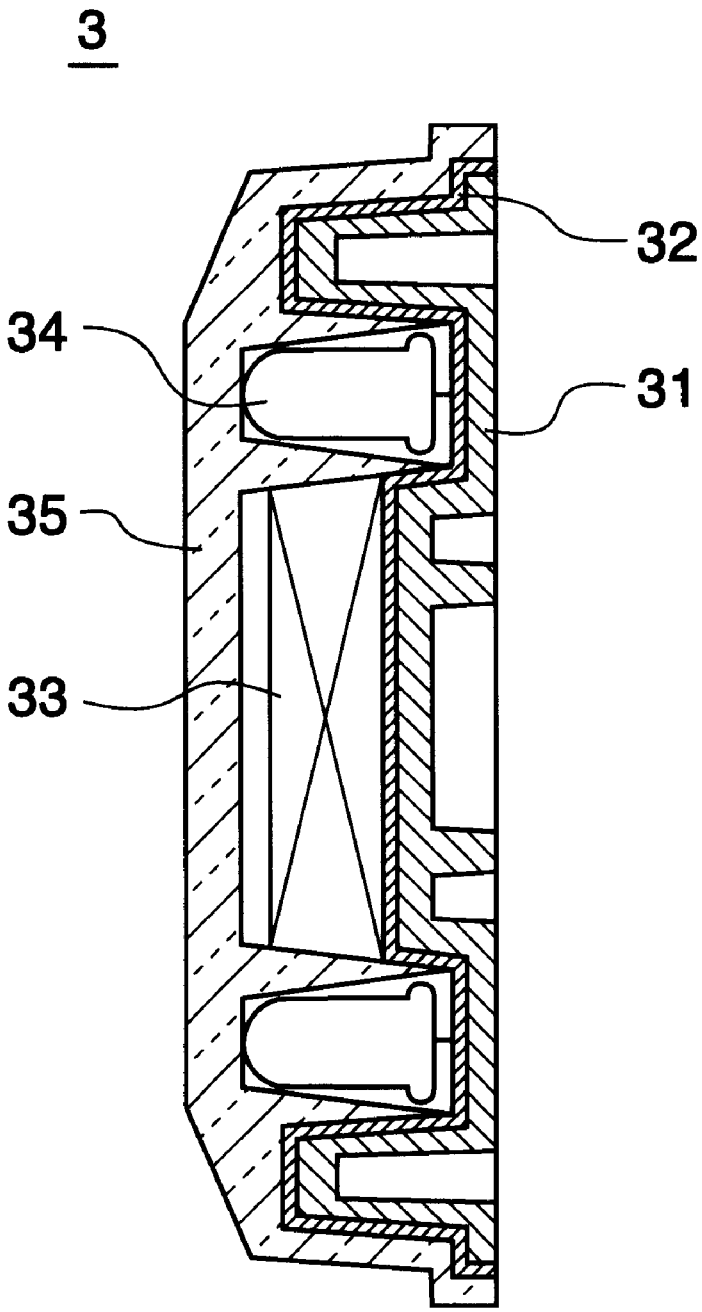
FIG. 6 is a section view along the line a—a of FIG. 5.

Inside the housing 113 is attached a solar-powered light emitter 3 as shown in FIG. 3 via the through hole 21 of the inner panel 2. The solar-powered light emitter 3 is shown in FIGS. 5 and 6, where a reflecting sheet 32 is adhered to a substrate 31; a solar cell device 33 is provided in the center part; and light emitting diodes (LED) 34 which emit light by this solar are provided in two positions, that is the upper and lower positions. Then a transparent upper case 35 is fitted to the substrate 31.

Figure 7:
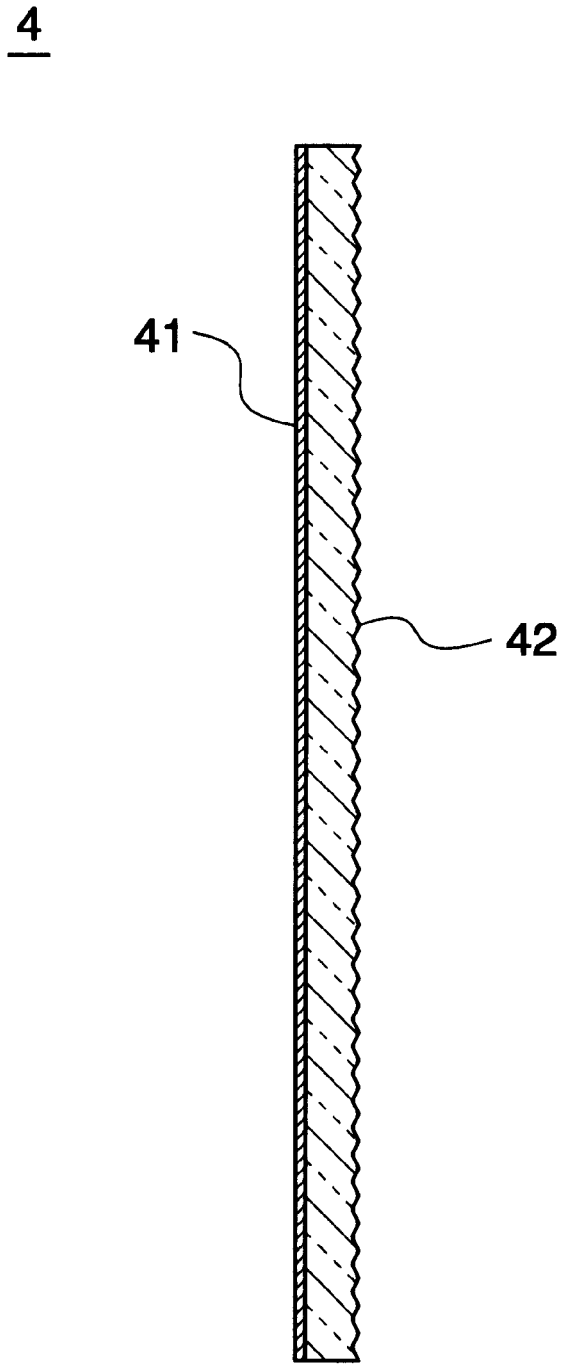
FIG. 7 is an enlarged section view of the reflecting panel.

Next, referring to FIG. 7, a front panel 4 is formed of a transparent plastic material such as polycarbonate resin or acrylic resin. The front surface thereof is coated with titanium oxide. Both sides of the front panel 4 may be smooth. However, it is particularly preferable that a rear surface of the front panel 42 has a cut surface on which a diamond cut is made to provide a prism effect to improve light reflecting efficiency, reflecting direction and performance. Titanium oxide is a photocatalyst which catalyzes decomposition of harmful substances by means of optical energy, and has been known to be effective in deodorization, antibacterial applications and air cleaning. In the present invention, the front surface 41 of the front panel 4 is coated with the titanium oxide. As this coating surface has been found to have the property of self-cleansing by the present inventor, the mud water and the like on the reflecting panel comes off and is cleaned up by this effect, this effect is employed in the present invention.

For assembling the reflecting mirror, the solar-powered light emitter 3 is press-fitted into the housing 113 of the holding part 11 of the holding member 1 and fixed there. Next, the inner panel 2 is inserted into the holding part 11 along the inner wall thereof, and the through hole 21 of the inner panel 2 is fitted with the apex of the solar-powered light emitter 3. Then, a tap screw is screwed into each of the attaching columns 112 through the small holes 22, and the inner panel 2 is fixed in contact with top surfaces of the ribs 111. Furthermore, the front panel 4 is fitted, press-fitted and fixed to the front surface opening of the holding part 11.

The reflecting mirror having the above configuration is disposed with its attaching part 12 fixed to a guardrail or a fake-wood column of the roadside made of scrapped plastic, using a belt, bolt and nut, at an angle enabling the reflecting mirror to reflect headlight of automobile. The solar cell device 33 of the solar-powered light emitter 3 accumulates electricity produce by the sunlight of daytime, and the light emitting diode 34 emits light at nighttime. Therefore, when the light from the automobile headlights meets the front panel 4 at nighttime, the light is reflected off the surface of the inner panel 2 on which reflecting surface work is made. Then, the reflected light is irregularly reflected by the diamond-cut surface of the rear surface of the front panel 4, thereby functioning as a driving sign. The solar-powered light emitter 3 is effective for duplicating the function as a driving sign. Furthermore, dirt adhered to the front surface 41 of the front panel 4 is cleaned up by the self-cleansing effect of titanium oxide with which the front surface is coated.

What is claimed is:

1. A reflecting mirror comprising:

a holding member formed of a synthetic resin, having a hollow holding part with a front surface opening and an attaching part for attaching to other members;

a housing formed in the holding part;

a inner panel provided in parallel with the front surface opening of the holding part in the holding part, the inner panel being a plate having a through hole and having a front surface formed into a reflecting surface;

a solar-powered light emitter disposed in the housing of the holding part and aligned with the through hole of the inner panel; and a front panel formed of a transparent plastic material attached to the front surface opening of the holding part.

2. The reflecting mirror according to claim 1, wherein the front surface of the front panel is coated with titanium oxide.

3. The reflecting mirror according to claim 1, wherein diamond cut is made on the rear surface of the front panel.

4. The reflecting mirror according to claim 1, wherein the holding member and the inner panel are formed of a recycled synthetic resin material.

5. The reflecting mirror according to claim 1, wherein the inner panel is formed of a granular plastic material consisting of a plastic and an inorganic additive added thereto, and has specular work on the front surface thereof, the plastic being selected from olefinic resins, ABS resin and styrol resin, the additive being selected from oxides, hydroxides, carbonates, sulfates, silicates, nitrides, carbons and potassium titanate.

6. The reflecting mirror according to claim 5, wherein the specular work is a work selected from deposition by aluminum or chromium, spattering deposition, electrolytic plating and nonelectrolytic plating.

7. The reflecting mirror according to claim 5, wherein the specular work is to adhere a hot stamp foil, on which specular work selected from deposition by aluminum or chromium, spattering deposition, electrolytic plating and nonelectrolytic plating has been previously made, onto the front surface.

8. The reflecting mirror according to claim 5, wherein the oxides are selected from diatomaceous earth, alumina, magnesium oxide, titanium oxide, zinc oxide and antimony oxide.

9. The reflecting mirror according to claim 5, wherein the hydroxides are selected from magnesium hydroxide, aluminum hydroxide and basic magnesium carbonate.

10. The reflecting mirror according to claim 5, wherein the carbonates are selected from calcium carbonate, magnesium carbonate and barium carbonate.

11. The reflecting mirror according to claim 5, wherein the sulfates are selected from calcium sulfate, calcium sulfite and barium sulfate.

12. The reflecting mirror according to claim 5, wherein the silicates are selected from calcium silicate, talc, kaolin clay, mica, zeolite, attapulgite, bentonite, sericite, aluminum silicate, feldspar powder, magnesium silicate and apatite.

13. The reflecting mirror according to claim 5, wherein the nitrides are silicon nitride and the carbons are selected from carbon black and graphite.

14. The reflecting mirror according to claim 5, wherein:

the oxides include at least one oxide selected from diatomaceous earth, alumina, magnesium oxide, titanium oxide, zinc oxide, silica and antimony oxide;

the hydroxides include at least one hydroxide selected from magnesium hydroxide, aluminum hydroxide and basic magnesium carbonate;

the carbonates include at least one carbonate selected from calcium carbonate, magnesium carbonate and barium carbonate;

the sulfates include at least one sulfate selected from calcium sulfate, calcium sulfite and barium sulfate;

the silicates include at least one silicate selected from calcium silicate, talc, kaolin clay, mica, zeolite, attapulgite, bentonite, sericite, aluminum silicate, feldspar powder, magnesium silicate and apatite;

the nitrides include silicon nitride;

the carbons include at least one of carbon black and graphite;

an amount of addition of silica, diatomaceous earth, alumina and magnesium oxide of the oxides is in the range of 20 to 60% by weight;

an amount of addition of titanium oxide, zinc oxide and antimony oxide of the oxides is in the range of 25 to 70% by weight;

an amount of addition of the hydroxides is in the range of 20 to 60% by weight;

an amount of addition of calcium carbonate and magnesium carbonate of the carbonates is in the range of 20 to 60% by weight;

an amount of addition of barium carbonate of the carbonates is in the range of 25 to 70% by weight;

an amount of addition of calcium sulfate and calcium sulfite of the sulfates is in the range of 20 to 60% by weight;

an amount of addition of barium sulfate of the sulfates is in the range of 25 to 70% by weight;

an amount of addition of the silicates is in the range of 20 to 60% by weight;

an amount of addition of the nitrides is in the range of 20 to 60% by weight;

an amount of addition of the carbons is in the range of 10 to 50% by weight; and an amount of addition of the potassium titanate is in the range of 20 to 60% by weight.

15. A reflecting device comprising:

an outer housing having sides defining an outer housing aperture and a back side opposed to the outer housing aperture;

an inner panel mounted in the outer housing and having a reflecting front surface for reflecting light through the outer housing aperture, the inner panel defining an inner panel aperture;

a solar-powered light emitter disposed aligned with the inner panel aperture to project light through the outer housing aperture; and a front panel formed of a transparent plastic material supported in the outer housing and closing the outer housing aperture, the front panel being disposed parallel to and displaced from the inner panel.

16. The reflecting device according to claim 15, wherein a front surface of the front panel is coated with titanium oxide.

17. The reflecting device according to claim 16, further comprising an inner housing disposed on said back side of said outer housing and housing said solar-powered light emitter.

18. The reflecting device according to claim 17, wherein the inner panel is displaced from the back side of the outer housing and at least a portion of said inner housing is disposed between said inner panel and said back side.

19. The reflecting device according to claim 15, further comprising an inner housing disposed on said back side of said outer housing and housing said solar-powered light emitter.

20. The reflecting device according to claim 19, wherein the inner panel is displaced from the back side of the outer housing and at least a portion of said inner housing is disposed between said inner panel and said back side.

* * * * *